US008333104B2

(12) United States Patent
Oberleitner

(10) Patent No.: US 8,333,104 B2
(45) Date of Patent: Dec. 18, 2012

(54) MEASURING INSTRUMENT FOR THE DETECTION AND EVALUATION OF AN IMPACT

(75) Inventor: Andreas Oberleitner, Zillingdorf (AT)

(73) Assignee: AIT Austrian Institute of Technology GmbH, Vienna (AT)

( * ) Notice: Subject to any disclaimer, the term of this patent is extended or adjusted under 35 U.S.C. 154(b) by 347 days.

(21) Appl. No.: 12/514,029

(22) PCT Filed: Nov. 7, 2007

(86) PCT No.: PCT/AT2007/000504

§ 371 (c)(1),
(2), (4) Date: Jan. 19, 2010

(87) PCT Pub. No.: WO2008/055279

PCT Pub. Date: May 15, 2008

(65) Prior Publication Data

US 2010/0307222 A1 Dec. 9, 2010

(30) Foreign Application Priority Data

Nov. 7, 2006 (AT) ..... A 1851/2006

(51) Int. Cl.
*G01M 7/00* (2006.01)

(52) U.S. Cl. ..... 73/12.04; 73/12.09

(58) Field of Classification Search ..... 73/12.01–12.14
See application file for complete search history.

(56) References Cited

U.S. PATENT DOCUMENTS

| | | | | |
|---|---|---|---|---|
| 5,079,728 | A * | 1/1992 | Adams et al. | 702/42 |
| 5,184,844 | A * | 2/1993 | Goor | 280/733 |
| 5,290,964 | A * | 3/1994 | Hiyoshi et al. | 84/600 |
| 5,365,799 | A | 11/1994 | Okada | |
| 5,402,535 | A * | 4/1995 | Green | 2/468 |
| 5,581,484 | A * | 12/1996 | Prince | 702/150 |
| 6,648,769 | B2 | 11/2003 | Lee et al. | |
| 6,669,563 | B1 * | 12/2003 | Kitami et al. | 463/36 |
| 6,907,391 | B2 * | 6/2005 | Bellora et al. | 703/8 |
| 7,736,242 | B2 | 6/2010 | Stites et al. | |
| 7,771,263 | B2 * | 8/2010 | Telford | 463/3 |
| 7,891,666 | B2 * | 2/2011 | Kuenzler et al. | 273/317 |
| 7,930,920 | B2 * | 4/2011 | Le Carpentier | 73/12.04 |

FOREIGN PATENT DOCUMENTS

| | | | |
|---|---|---|---|
| DE | 19816389 | A1 | 6/1999 |
| EP | 0549807 | A1 | 7/1993 |
| WO | 0069528 | A1 | 11/2000 |
| WO | 2005094953 | A2 | 10/2005 |

* cited by examiner

*Primary Examiner* — Max Noori
(74) *Attorney, Agent, or Firm* — Laurence A. Greenberg; Werner H. Stemer; Ralph E. Locher

(57) ABSTRACT

A measuring device for detecting and evaluating an impact, jolt or the like is formed with an impact face, against which the impact, jolt or pulse which is to be evaluated strikes. A sensor, for example a force sensor, detects values of the force which act on the impact face as a result. A sensor, for example an acceleration sensor, detects values of the acceleration which act on the impact face as a result. An evaluation unit processes the determined force and acceleration values.

25 Claims, 3 Drawing Sheets

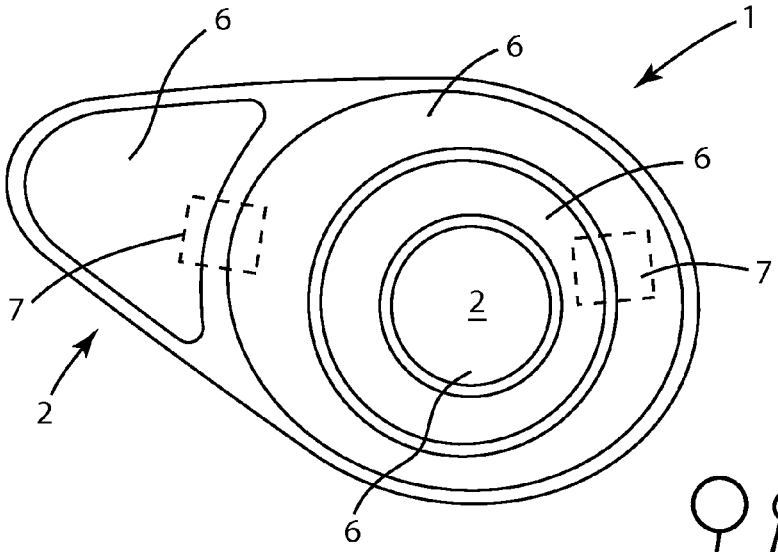
FIG. 7
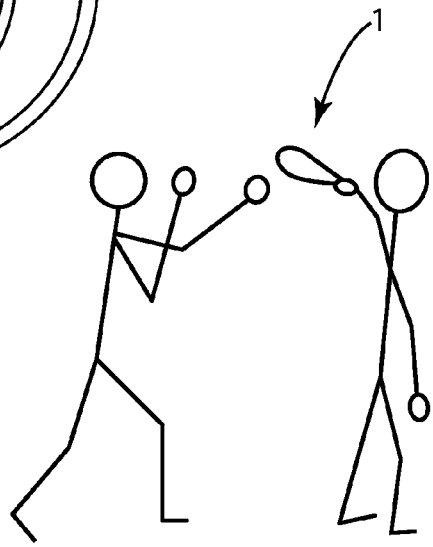
FIG. 8
FIG. 9
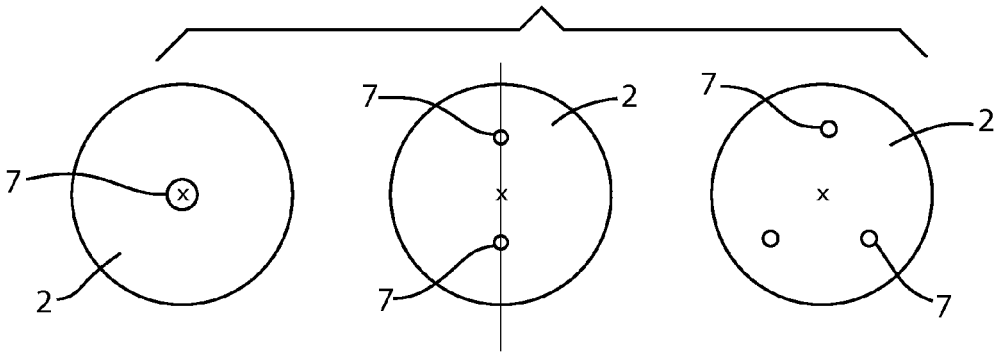
FIG. 10
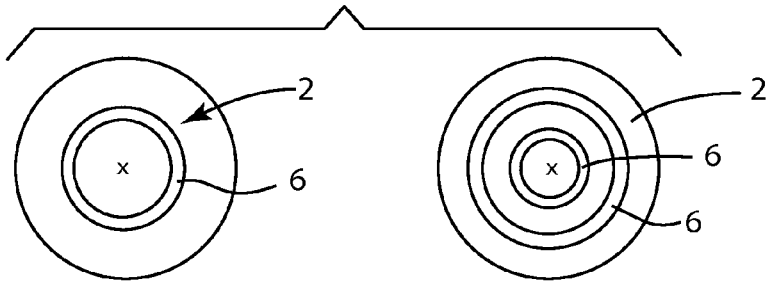

MEASURING INSTRUMENT FOR THE DETECTION AND EVALUATION OF AN IMPACT

BACKGROUND OF THE INVENTION

Field of the Invention

The invention concerns a measuring instrument in accordance with the claims.

In martial arts, in particular in full contact sports and in self defense, one is anxious to increase by physical training the "impact effect". Beside the physiological, psychological and tactical component, the physical component, i.e. physical parameters, like e.g. force, is the main aspect for the evaluation of the impact effect. The impact effect describes in principle the transmission of energy during this impact process. It concerns thereby dynamic processes, since the person affects the impact directly before, while and after the hit, for example by body exertion, influence of the times of contact etc. Besides that, also the person, who holds the target, affects the hit effect at mobile solutions. The simultaneous consideration of force, time and space and/or impact depth can be used for the determination of the so-called shock strength, i.e. a very high force occurring during a very short time period.

Forces in the biomechanics are mainly measured with force surface plates. Such plates are firmly connected with a reference system i.e. fastened to a rigid wall and measure the application of force on this rigid plate. However, such systems in the biomechanics can deal only with static or quasi-static forces, i.e. when slow changes of force and/or small amounts of force occur, since impacts with a large force and large acceleration are risky for injuries on such a rigid plate. In addition such systems can be used in measurements, where the applied forces move the exercising body away of the plate, e.g. during jump power measurement. Therefore, such systems are only conditionally or even not at all suited for impact force measurement. Besides such systems are very expensive in the acquisition, and usually not mobile, but assume an assembly at an immovable, rigid and massive body, e.g. a wall.

The direct application of such transducers in handheld equipment is therefore not possible (moving, not reproducibly flexible target) and requires a consideration of force and kinetic parameters. The available invention does make the determination possible for the first time, partially of the directly measurable characteristics substantial for the impact process. The realization takes place in accordance with the patent claims.

Particularly for the martial arts, there are already some beginnings, in order to objectivate training progress concerning the impact force. However, these are accommodated either in rigid constructions, which increases the danger of substantial injury, or only individual, parameters suitable to only a limited extent can be determined. For example the determination of the "impact effect" is missing, i.e. transfer of energy and their course of time.

So for example in GB 2,372,220, DE 20001615 U1 or EP 1 221 333 fixed surface plates mounted on walls are mentioned. Thereby the dangers of injury described above at impacts against a rigid obstacle are unfavourable. Besides, a yielding goal better simulates the real situation of a hit e.g. on a body.

Furthermore, measurement of force of an impact or the acceleration of the impact is well-known from the state of the art.

Thus for example a box bag with integrated Acceleration sensor is described in the DE 103 23 348 A1. From U.S. Pat. No. 6,611,782, a measuring instrument using a force sensor is well-known for the impact effect. Also the surface plates mentioned above measure either only force of the impact or its acceleration. All further necessary parameters are then deduced from this quantity.

However, such a measurement of only one value, thus of force or acceleration, works only with a constant well-known mass, as this is known, for example, with fixed mounted measuring plates and, hence, is not suited for a "hand held function" with which the measuring setup is held in the hand. Similar Handheld devices are known for example from U.S. Pat. No. 3,270,564 or U.S. Pat. No. 6,441,745 B1 at golf clubs or tennis racquets; however, also in those cases, either only force or acceleration is measured.

BRIEF SUMMARY OF THE INVENTION

Task of the invention is to create a constructively simple and light measuring instrument with which the impact effect can be measured and judged. Furthermore, it is a task of the invention to design the measuring instrument constructionally in such a way that this is applicable as hand held equipment, which can be used particularly in martial arts training without danger of injury.

This task is solved by the characteristics of claim 1. The invention describes in favourable manner a portable hand held equipment, which measures and registers values of both force and acceleration, for example of an impact, and determines from this the affected mass, speed, way, momentum, transferred energy and power. These are meaningful parameters for the evaluation of the effect of a strike movement. By the registration of values of both parameters, i.e. force and acceleration, the measuring instrument becomes mass independent and thus is suited for hand held applications.

For the measurement of force and acceleration, sensors are included directly in the device. A controller system takes over the remaining processing. The arrangement of force and acceleration sensors directly in the impact pad allows an absolutely training-everyday life-suited employment without danger of injury. No preparations are to be carried out inevitably around the measurements, this leads to a plug-and-play-function. Moreover, the production costs are very small in comparison to other devices. The accessory can be held, as it is usual in the training, by a training partner and must not be mounted on a bearer or a wall what reduces, in addition, the danger of injuries considerably.

The number of directly measured parameters is with force and acceleration higher than for known devices, which determine only one size; therefore, the system is more meaningful. Thus, primarily force and acceleration are acquired. From this, a plurality of further parameters can be determined through physical connections. Beside the primary, actually already important parameters force and acceleration, in further consequence the speed, way, momentum, transferred energy, power can be computed. These parameters are essential for the evaluation of the impact and its effect, since these actually represent the parameters to optimize in training by motion technique.

A time- and track-dependent "pseudo inertia mass" respectively is assumed, which unite the effects of the genuine inertia mass, i.e. the system impact pad retaining arm and the additionally arising resistive forces, i.e. the additional muscle power of the holding arm. This value is not determinable with other one dimensional measuring systems, whereby the values specified above cannot be determined. This "pseudo inertia mass" is determined at each time in accordance with the sampling rate, whereby the system with the application of the physical connections already mentioned, e.g. the determination of the energy, the momentum etc., can be made independent of the knowledge of the mass and the resistance strengths.

Further favourable arrangements of the invention are demonstrated in the dependent claims. The favourable arrangement of the sensors in accordance with claim 2 ensures that the forces released by possible hits and/or impulses are easy and well measurable.

Favourable arrangements of the measuring instrument are given by the characteristics of claim 3. Like that it is possible to measure different performance parameters in different kinds of sport in order to judge and optimize the performance of the athlete objectively.

In order to avoid dangers of injury and to allow an effective arrangement of the sensors, it is favourable to realize the characteristics of the claim 4. Favourably applicable force sensors are given by the characteristics of claim 5.

In this context, it is particularly favourable to realize the characteristics of claim 6 since thereby a good force measurement can be achieved.

A favourable kind of acceleration sensors, with which accelerations are good and reproducibly measurable, is given by the characteristics of claim 7.

The acceleration sensors can be arranged in favourable way on the measuring instrument and/or target surface in accordance with claim 8 to 10. Thus it is possible to evaluate the acceleration of a strike or an impact in the best possible way and/or to analyze, even if the strike does not hit each time on the same position of the target surface and/or is placed somewhat decentralized. The arrangement of the acceleration sensors in accordance with these claims ensures also high reproducibility of the results of measurement.

The characteristics of the claims 11 to 14 describe favourable arrangements and designs of the force sensors. Thus it becomes possible to measure the forces, which affect the target surface, as reproducibly and well as possible and to achieve a high accuracy in relative independence from the exact position of the hit. This can be achieved particularly favourably by the characteristics of the claims 12 to 14.

An alternatively designed target surface, which is used in particular with Hand Mitts with a handle, is designed in accordance with claim 15.

A further possibility for the favourable arrangement of force sensors is given in accordance with the characteristics of claim 16.

The characteristics of claim 17 ensure a multifaceted processability of the results.

In claim 18 a training device is described, which covers a measuring instrument according to the invention, with which in different kinds of sport active or passive impact or impact processes can be analyzed. Thus, the measuring instrument is variously applicable.

Further advantages and arrangements of the invention result from the description and the enclosed designs. The invention is represented on the basis of implementation examples in the drawings schematically and is described in the following with reference to the drawings by way of example.

BRIEF DESCRIPTION OF THE SEVERAL VIEWS OF THE DRAWING

FIG. 7 shows the force sensors and the acceleration sensors of the Hand Mitt in accordance with FIG. 6.

FIG. 8 shows the application of the Hand Mitt.

FIG. 9 shows arrangement possibilities for acceleration sensors.

FIG. 10 shows arrangement possibilities for force sensors.

DESCRIPTION OF THE INVENTION

Figure 1:
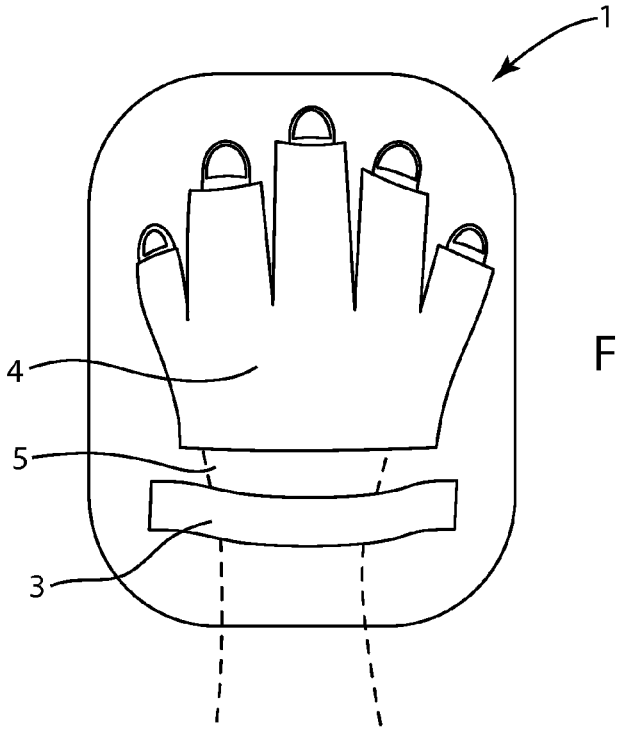
FIG. 1 shows the back of a measuring instrument according to the invention in form of a Coaching Mitt.

In the drawings, two different implementation forms of a measuring instrument according to invention 1 are represented. In the FIG. 1 to 5, a so-called Coaching Mitt is described, in the FIG. 6 to 8 a so-called Hand Mitt is displayed.

Figure 2:
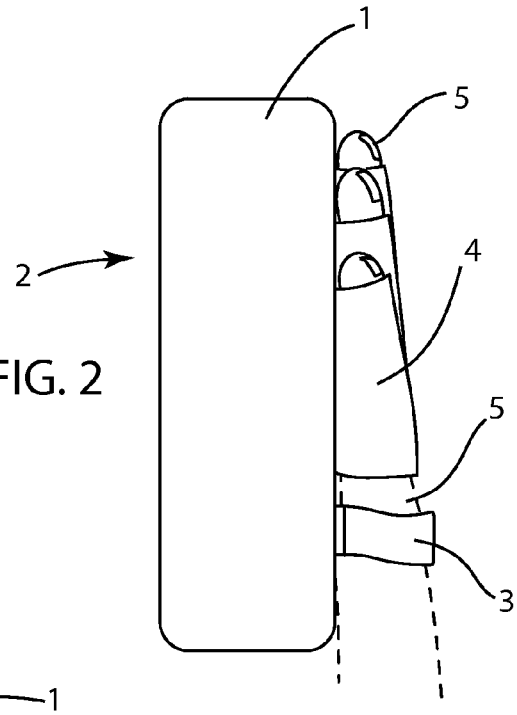
FIG. 2 shows a side view in accordance with FIG. 1.

A Coaching Mitt is a training device used in particular for training of martial arts techniques. Such a Coaching Mitt is tightened like a glove and/or fastened to the hand or lower arm 5. In FIG. 1 and FIG. 2, the attachment on a hand 5 is represented. With this implementation form the hand 5 is connected at the palm with the Coaching Mitt 1 by a fixation 3 at the lower arm and a fixation 4. On the side of the measuring instrument and/or the Coaching Mitt 1 opposite to the hand 5, a target surface 2 is designed, which takes up the expected punch or kick and/or on which the punch or kicks has an effect.

Figure 5:
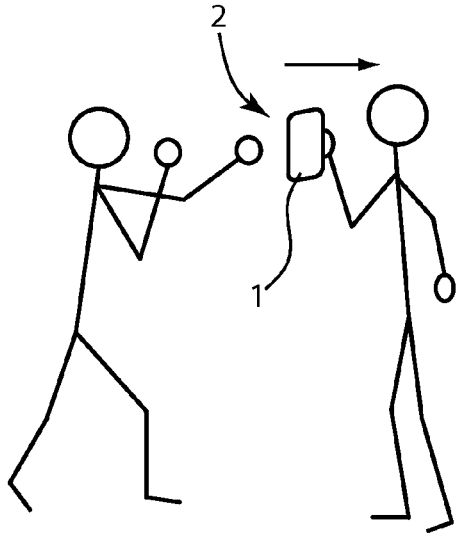
FIG. 5 shows the application of the measuring instrument in form of a Coaching Mitt.

In FIG. 5 the application of the Coaching Mitt 1 is shown. The right person in FIG. 5 holds the Coaching Mitt 1 in the hand 5 with the target surface 2 turned to a second person, which is the training person. This person hits the target surface 2. Thus, the impact vector goes through the part of the body holding, i.e. e.g. through the hand 5 of the right person. Such a Coaching Mitt 1 is used above all when it is necessary to be able to oppose more resistance to the blows.

If an impact meets the target surface 2, the Coaching Mitt 1 is pressed to the right in an circle-arc-shaped course from its starting position into a final position. As axis of rotation and/or turning center works thereby, as in FIG. 5 represented, the elbow of the right person. By this movement of the Coaching Mitt 1, a movement plane is defined. This movement plane runs through the center of the target surface 2 in the starting position, through the center of the target surface 2 in the final position as well as through the turning center and/or the elbow. In FIG. 5, the movement plane is aligned vertically to the ground.

Figure 3:
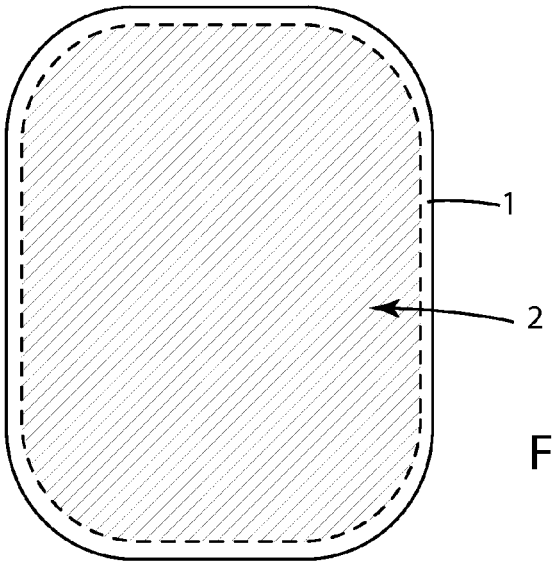
FIG. 3 shows a front view in accordance with FIG. 1.
Figure 4:
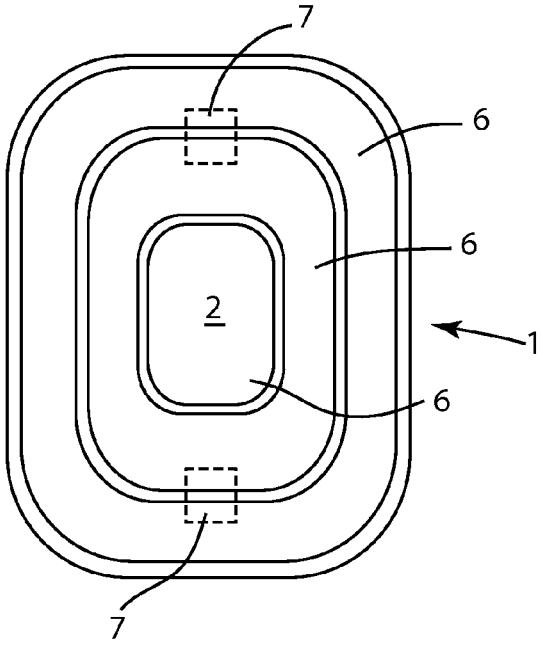
FIG. 4 shows the arrangement of the force sensors and the acceleration sensors of the measuring instrument inside the Coaching Mitts.

FIG. 3 shows the Coaching Mitt 1 from the front, whereby the front is protected by a dirt- and humidity-rejecting cover. In FIG. 4, the Coaching Mitt with removed cover is shown, whereby the arrangement of the sensors 6, 7 of the measuring instrument 1 is recognizable. Three force sensors 6 are intended, implemented as capacitive, inductive, piezo- or FSR force sensors in this example. The three force sensors 6 are arranged circular around the center of the target surface 2 and cover almost the entire target surface 2.

In addition, two acceleration sensors 7, located on the target surface 2, are, on a vertical, in particular perpendicular, line in the prospective movement plane of the Coaching Mitt 1 caused by the impact with regard to the axis of rotation and/or the turning center, i.e. in this case the elbow, are arranged. The two acceleration sensors 7 lie both in the same distance and diametrically to the center of the target surface 2.

Figure 6:
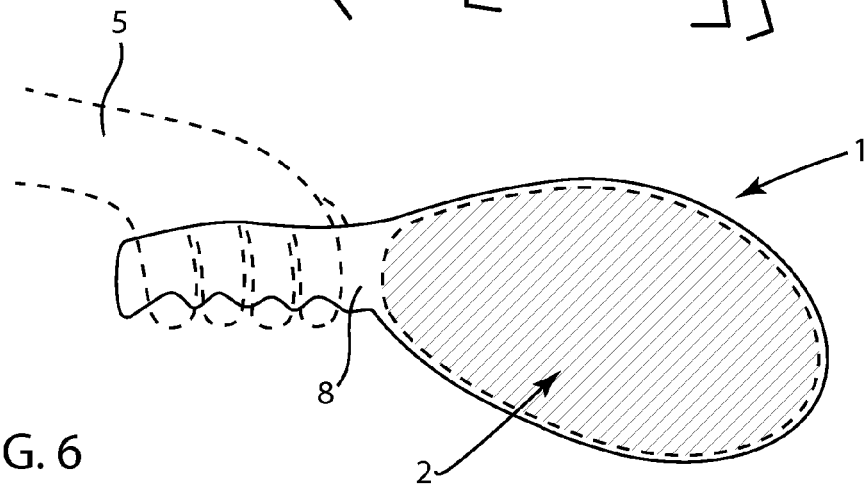
FIG. 6 shows a measuring instrument according to the invention in form of a Hand Mitt.

In FIG. 6 to 8, a further implementation form of a measuring instrument 1 is represented, which is out-arranged in form of a Hand Mitt. Such a Hand Mitt 1 is, as shown in FIG. 8, held by a training partner like a racquet. In FIG. 8, the left person, which is the training person, hits the target surface 2 of the Hand Mitt 1. In contrary to the Coaching Mitt 1, the impact vector does not go through the part of the body holding, i.e. the hand 5, but only through the target surface 2. Such a Hand Mitt 1 is above all used, if a goal with less resistance is to be needed, to achieve larger accelerations and/or velocities.

If an impact hits the target surface 2, the Hand Mitt 1 is brought, like the Coaching Mitt 1, in a circle-arc-shaped course from its starting position to the right into a final position in accordance with FIG. 5. However, not the elbow works thereby as axis of rotation and/or turning center, but rather the shoulder joint of the right person. By this movement of the Hand Mitt 1, a movement plane is defined. This movement plane runs through the center of the target surface 2 in the starting position of the Hand Mitt 1, through the center of the target surface 2 in the final position as well as through the turning center and/or the shoulder joint. In FIG. 5, the movement plane is aligned diagonally and/or almost horizontal to the ground.

In FIG. 6, the fundamental structure of such a Hand Mitt 1 is represented, whereby a handle 8 is intended, to which the target surface 2 connects. The target surface 2 of this in FIG. 6 represented implementation form is not circular or oval out-arranged, but has a rather oblong basic form. At differently arranged Hand Mitts 1 the target surface 2 can also be out-arranged in a circle or oval shape.

In FIG. 7, the target surface 2 of FIG. 6 is displayed in detailed view. The target surface 2 is divided into two ranges: in a right subrange, which essentially exhibits circle or an oval surface area, and a left essentially triangular subrange near the hand grip 8.

In the right subrange, three force sensors 6 are arranged, similar to the implementation form in accordance with FIG. 1 to 5 as concentric rings around a center of the right subrange of the target surface 2. Also in this implementation form, the force sensors 6 are designed flatly.

A further force sensor 6 is arranged in the left subrange of the target surface 2 and represents an essentially triangular surface area.

In addition, two acceleration sensors 7, located on the target surface 2, are arranged in a straight line, in particular in an extension of the handle 8, in the movement plane presumably caused by the impact with regard to the axis of rotation and/or the turning center. The two movement sensors 7 can be arranged in same distance and/or diametrically to the center of the right part of the target surface 2. Further arrangement possibilities for the force sensors 6 and the acceleration sensors 7 are displayed in FIGS. 9 and 10.

As force sensors 6, capacitive receivers can be used, with which forces affecting them cause a change in distance of a plate capacitor and thus a change in the capacity and impedance, Moreover, there is conceivable the usage of inductive receivers, which work according to the moving coil principle or Hall sensors. Furthermore, also so-called FSR (Force Sensing Resistance and/or Force Sensitive Resistor) sensors are possible, with which the resistance value changes by the application of force, and/or foils, whereas voltages are generated proportionally to the mechanical influence by the piezoelectric effect.

As acceleration sensors, advantageously MEMS (Micro Electro Mechanical System) sensors are used. These are characterised by a far measuring range, good linearity as well as its small and durable design.

With the measuring instrument according to invention 1 two parameters, i.e. on the one hand the concrete force values and on the other hand the concrete acceleration values, are determined directly. Thus the system becomes more meaningfully, because, besides, from only one parameter at mobile applications, the further interesting values can not derived. Also the measuring instrument 1 thereby becomes mass-independent and is suitable for the use as handheld equipment, which for is favourable for training devices. The force values and the acceleration values are accordingly registered on a value basis and the concrete values flow into the evaluation and the calculation of the characteristics for the qualitative evaluation of the impact, like e.g. the power, etc. Thus, with the measuring instrument according to invention 1 it is not only determined whether a certain threshold and/or a certain limit value is crossed, for example whether the impact exceeds a certain minimum strength and only then is at all seized.

From the determined values force and acceleration, a plurality of further parameters are determined through well-known physical connections, which supply a statement about the quality of the hit. Beside the primary, actually already important parameters force and acceleration, know so speed, way, momentum, transferred energy, power can be computed:

Velocity $v(t)=a(t)*dt$ (including determination of the maximum speed)

Covered distance of the target $s(t)=\int v(t)*dt=\iint a(t)\,dt^2$

Momentum $p(t)=\int F(t)*dt$

Transferred energy $W(t)=F(t)*s(t)=F*a*t^2=F(t)*\iint a(t)\,dt^2$

Power $P(t)=W(t)/t=F*a*t=F(t)*a(t)*dt$

Furthermore, time conditions can be determined, for example the relationship between contact- and die time. In addition also the affected mass $dm(t)=dF(t)/da(t)$, depending upon the resistance of the training partner, can be computed.

In addition, all parameters are given in their time course, not only for example as scalar maximum value. So from the morphologic course of the curve and/or the profile, important information about the performance of the implemented impact can be determined.

Additionally, it is possible to judge aim- and hit accuracy by the use of several sensors distributed over the entire Target surface. For this, different algorithms, e.g. triangulation, can be used. In the case of appropriate resolution, i.e. number of force sensor areas, also the pressure as force per surface of the area can be determined. With the realization of the measuring instrument 1 as a Hand Mitt, two acceleration sensors 7 in the equipment can be installed, in order to determine also rotation speeds and turning radii.

The measuring instrument 1 possesses advantageously an integrated display, on which the results can be displayed. Besides, the connection through a data interface (e.g. over cables, radio, NFC, optical or other methods) to a data processing equipment (for example PC, PDA, mobile telephone etc.) is possible, to indicate results and store them in a data base, for example to support assessment of physical performance. In addition, also whole training programs and set points can be integrated.

The power supply is made preferably by means of integrated accumulators, which can be recharged, either conventionally or by admission of kinetic energy.

The conversion for other kinds of sport is just as possible with an appropriate adaptation. In principle, each sport equipment, which is actively or passively involved in impact processes, can be equipped with the system, for example all kinds of sport, with which a played object is hit by a racquet or a part of the body, like e.g. Football, Volleyball, tennis, table tennis, baseball, Hockey, ice hockey, gulf, Cricket, Polo etc., whereby the measuring instrument 1 and/or the sensors 6.7 in the racquet and/or Part of the body (clothing, e.g. shoe, glove) accommodated and/or are fastened to the racquet/part of the body.

The measuring instrument is also applicable for the diagnostics of the release behavior for kinds of sports, in which an object is thrown or pushed, for example for ball pushing, javelin, discus etc.

In principle two cases are to be distinguished: in the first case an active part (part of the body, racquet, object) hits a target with measurement unit (e.g. fist on Mitt, ball on glove, racquet on ball). In this case the collection takes place in the target, which is naturally not rigidly embodied. In the second case a moved, active part, equipped with the measuring instrument (part of the body/article of clothing, racquet) hits a target (ball, object, etc.).

In both cases, the capture of the parameters is generally only allowed by the invention-appropriate measuring arrangement, because in all cases, movable/moved objects are to be looked which are partially connected with a body part and lead, in particular through this coupling, to dynamically variable parameters, which are not detectable by present methods.

The invention claimed is:

1. An impact pad, comprising:

a surface forming an impact surface defining a target surface;

an impact measuring device for detecting an impact, punch, or impulse impinging upon the target surface, said impact measuring device including:

at least one force sensor for detecting a value of a force acting upon the target surface due to the impact, punch, or impulse;

at least one acceleration sensor for detecting a value of an acceleration of the target surface due to the impact, punch, or impulse;

said force sensor and said acceleration sensor being operatively connected with the target surface and being disposed on or behind the target surface; and an evaluation unit connected to receive signals from said force sensor and said acceleration sensor and configured to process the force values and the acceleration values detected by said force sensor and said acceleration sensor, respectively, and configured to compute the characteristic variables for qualitative evaluation of the impact, punch, or impulse, from the concrete force values and the acceleration values;

said evaluation unit being configured to calculate parameters of velocity, an impact direction, a momentum, an amount of transferred energy, and a power in the qualitative evaluation;

wherein all acquired parameters are given in a time course, so from a morphologic course of a curve or a profile, a performance of the impact is determined.

2. The impact pad according to claim 1, configured for integration in a coaching mitt or hand mitt.

3. The impact pad according to claim 1, wherein the target surface is substantially circular or oval.

4. The impact pad according to claim 1, wherein said at least one force sensor is at least one sensor selected from the group consisting of capacitive sensors, inductive sensors, and FSR (Force Sensing Resistor) sensors.

5. The impact pad according to claim 1, wherein said at least one force sensor is a laminar force sensors covering at least a major part of the complete target surface.

6. The impact pad according to claim 1, wherein said at least one acceleration sensor is a micro electro-mechanical system sensor.

7. The impact pad according to claim 1, wherein said acceleration sensor is a single sensor disposed at and/or near a center of the target surface and/or centrally behind the target surface in an impact direction.

8. The impact pad according to claim 1, wherein said acceleration sensor is one of two acceleration sensors disposed in at least one way selected from the group consisting of:

on a line defined in a direction of movement of said impact measuring device; and on a movement plane defined by a center of the target surface in a starting position, by the center of the target surface in a final position, and a center of rotation, around which said impact measuring device is moved in use.

9. The impact pad according to claim 8, wherein the center of rotation is defined by an elbow of a person using the impact pad.

10. The impact pad according to claim 8, wherein said two acceleration sensors are disposed in at least one way selected from the group consisting of:

equidistantly from the center of the target surface; and diametrically to the center of the target surface.

11. The impact pad according to claim 8, wherein said two acceleration sensors are disposed in an extension of a handle.

12. The impact pad according to claim 1, wherein said at least one acceleration sensor is one of three acceleration sensors on the target surface, said three acceleration sensors spanning a plane lying substantially perpendicularly to a direction of an impact vector.

13. The impact pad according to claim 12, wherein said three acceleration sensors are arranged in the plane equidistant from the center of the target surface.

14. The impact pad according to claim 12, wherein said three acceleration sensors are disposed equidistant from the center of the target surface and a regular intervals relative to each other.

15. The impact pad according to claim 1, wherein said force sensor is a single force sensor formed as a laminar sensor covering a substantial portion of the target surface.

16. The impact pad according to claim 15, wherein said single force sensor is a capacitive force sensor covering the target surface substantially completely.

17. The impact pad according to claim 15, wherein said force sensor is disposed circularly around the center of the target surface.

18. The impact pad according to claim 1, wherein said at least one force sensor is at least two circular force sensors disposed concentrically around the center of the target surface.

19. The impact pad according to claim 18, wherein the target surface is formed as an approximately circular or oval target surface.

20. The impact pad according to claim 18, wherein said circular force sensors have a ring width of at least 10 millimeters.

21. The impact pad according to claim 1, wherein the target surface has a circular or oval first section and a second section contiguous with the first section and covering a remaining target surface, each of the first and second sections having at least one force sensor.

22. The impact pad according to claim 1, wherein said at least one force sensor is one of at least three punctiform force sensors disposed in a common plane aligned substantially perpendicularly to a blow direction.

23. The impact pad according to claim 22, wherein said three force sensors are FSR sensors.

24. The impact pad according to claim 22, wherein said three force sensors are disposed, linearly independently, equidistantly to the center of the target surface, and equidistantly from one another.

25. The impact pad according to claim 1, wherein said evaluation unit is configured to calculate:

the velocity from the acceleration detected by said at least one acceleration sensor;

the momentum from the force detected by said at least one force sensor;

the amount of transferred energy from the force detected by said at least one force sensor and from the acceleration detected by said at least one acceleration sensor; and the power from the force detected by said at least one force sensor and from the acceleration detected by said at least one acceleration sensor.

* * * * *